US005961354A

United States Patent [19]

Hashim

[11] Patent Number: 5,961,354

[45] Date of Patent: Oct. 5, 1999

[54] ELECTRICAL CONNECTOR ASSEMBLY

[75] Inventor: Amid I. Hashim, Randolph, N.J.

[73] Assignee: Lucent Technologies, Inc., Murray Hill, N.J.

[21] Appl. No.: 08/782,356

[22] Filed: Jan. 13, 1997

[51] Int. Cl.[6] ..... H01R 23/02

[52] U.S. Cl. ..... 439/676; 439/941; 439/344

[58] Field of Search ..... 439/676, 941, 439/76.1, 344

[56] References Cited

U.S. PATENT DOCUMENTS

| | | | |
|---|---|---|---|
| 4,648,167 | 3/1987 | Arcer | 439/676 |
| 4,767,355 | 8/1988 | Phillipson et al. | 439/676 |
| 5,186,647 | 2/1993 | Denkmann et al. | 439/395 |
| 5,226,835 | 7/1993 | Baker, III et al. | 439/941 |
| 5,299,956 | 4/1994 | Brownell et al. | 439/638 |
| 5,310,363 | 5/1994 | Brownell et al. | 439/676 |
| 5,362,257 | 11/1994 | Neal et al. | 439/941 |
| 5,403,200 | 4/1995 | Chen | 439/941 |
| 5,414,393 | 5/1995 | Rose et al. | 439/676 |
| 5,432,484 | 7/1995 | Klas et al. | 333/1 |
| 5,571,035 | 11/1996 | Ferrill | 439/941 |
| 5,586,914 | 12/1996 | Foster, Jr. et al. | 439/941 |
| 5,618,185 | 4/1997 | Aekins | 439/941 |

OTHER PUBLICATIONS

"Commercial Building Telecommunications Cabling Standard: ANSI/TIA/EIA–568–A," Telecommunications Industry Association, ¶ B.5.1, FIGS. B–3—B–5, Oct. 1995.

"Anixter 1996 Structured Cabling Solutions Catalog," Anixter Inc., p. 1–171, 1996.

"Full Line Catalog #1100R," Hubbell Premise Wiring, Inc., pp. 78–79, undated.

*Primary Examiner*—Paula Bradley
*Assistant Examiner*—Tho D. Ta

[57] ABSTRACT

Electrical connectors for electrically and physically connecting cable conductors to mating connectors frequently require precise and demanding assembly in order to produce a required level of crosstalk. In many instances, this level must be a set amount, rather than the lowest level possible, in order to match a canceling crosstalk being produced in the mating connector. The present invention is a crossover lead frame connector which reduces the demands upon the assembler in assembling the connector and cable, and yet still provides the precise level of crosstalk required in the connector. These advantages are realized by the use of a crossover lead frame structure which controls the physical length and routing of the signals between the cable conductors and connector pins. This allows the manufacturer to match the connector to the layout of the cable conductors and fix the level of crosstalk that will be produced at the time the connector is manufactured.

24 Claims, 6 Drawing Sheets

ELECTRICAL CONNECTOR ASSEMBLY

BACKGROUND OF THE INVENTION

This invention relates to electrical connectors. Electrical connectors are widely used in telecommunications, computer networks, and other types of electronic systems. More particularly, the invention relates to electrical connectors, such as modular plugs, for use with crosstalk canceling jacks.

Crosstalk canceling jacks are used to minimize the total crosstalk produced in a plug-jack connection. These jacks minimize the total crosstalk in the connection by producing an equal but opposite crosstalk in the jack to that generated in the attached plug. The amount of crosstalk produced by the jack is based on estimated levels of crosstalk produced in compatible plugs and is fixed at the time the jack is manufactured.

For the jack to effectively minimize the total crosstalk, the crosstalk produced in the attached plug must be at the level for which the jack has been calibrated. In the prior art, this has been accomplished by precisely wiring the plug in conformance with plug wiring requirements. These requirements usually dictate plug wiring characteristics such as the arrangement of the signals at the plug's pins (pin-signal assignments), and the length and routing of the cable conductors in the plug's body.

An example of such a plug wiring requirement is modular plug specification TIA-568A which defines the wiring requirements for a four twisted-pair modular plug. This specification requires, inter alia, that the conductors of one twisted pair of the cable be connected to two non-adjacent plug pins. Under this requirement, these conductors must be carefully untwisted, fanned out, and routed to the pins by the assembler to maintain the calibrated level of crosstalk.

If the plug is inadvertently wired inconsistently with its precise and demanding wiring requirements, the level of crosstalk produced by the plug may be either too high or too low. For example, if two or more of the conductors are kept parallel and placed too close to each other over too long a distance within the plug, significant crosstalk may occur between them. When this crosstalk is combined with the crosstalk generated by the jack, the two may not cancel out, causing a degradation of the connection's overall transmission performance.

At the extremes, these degradations may result in the plug-jack connection failing its performance requirements. In the event of such a failure, the suspect cable assembly will have to be repaired or replaced, resulting in increased manufacturing costs.

It is therefore an object of this invention to provide an electrical connector which can be used to manufacture cable assemblies of consistent quality.

It is another object of this invention to provide an electrical connector which can be used to manufacture cable assemblies of consistent quality by simplifying the connector-cable assembly process.

It is still another object of this invention to provide an electrical connector which can be used to construct cable assemblies of consistent quality by including a mechanism for controlling the crosstalk produced in the connector without requiring precise wiring during assembly.

SUMMARY OF THE INVENTION

These and other objects of the invention are accomplished in accordance with the principles of the invention by providing an electrical connector having a crossover lead frame structure which simplifies the connector assembly process and controls the crosstalk generated in the connector. The crossover lead frame structure simplifies the connector assembly by providing cable conductor termination points which are arranged to match the order of the cable conductors rather than the order of the signals required at the connector pins. This arrangement enables the assembler to connect similar types of cables to different variations of connectors in a consistent manner regardless of the connector's pin-signal assignments. Additionally, the crossover lead frame structure controls crosstalk in the connector by substantially fixing the pin-signal assignments, conductor lengths, and conductor routing inside the connector body at the time the connector is manufactured. Thus, the crossover lead frame structure eliminates the need for complex connector-cable assembly instructions and allows control over connector crosstalk without requiring precise control over the length and routing of cable conductors during connector-cable assembly.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
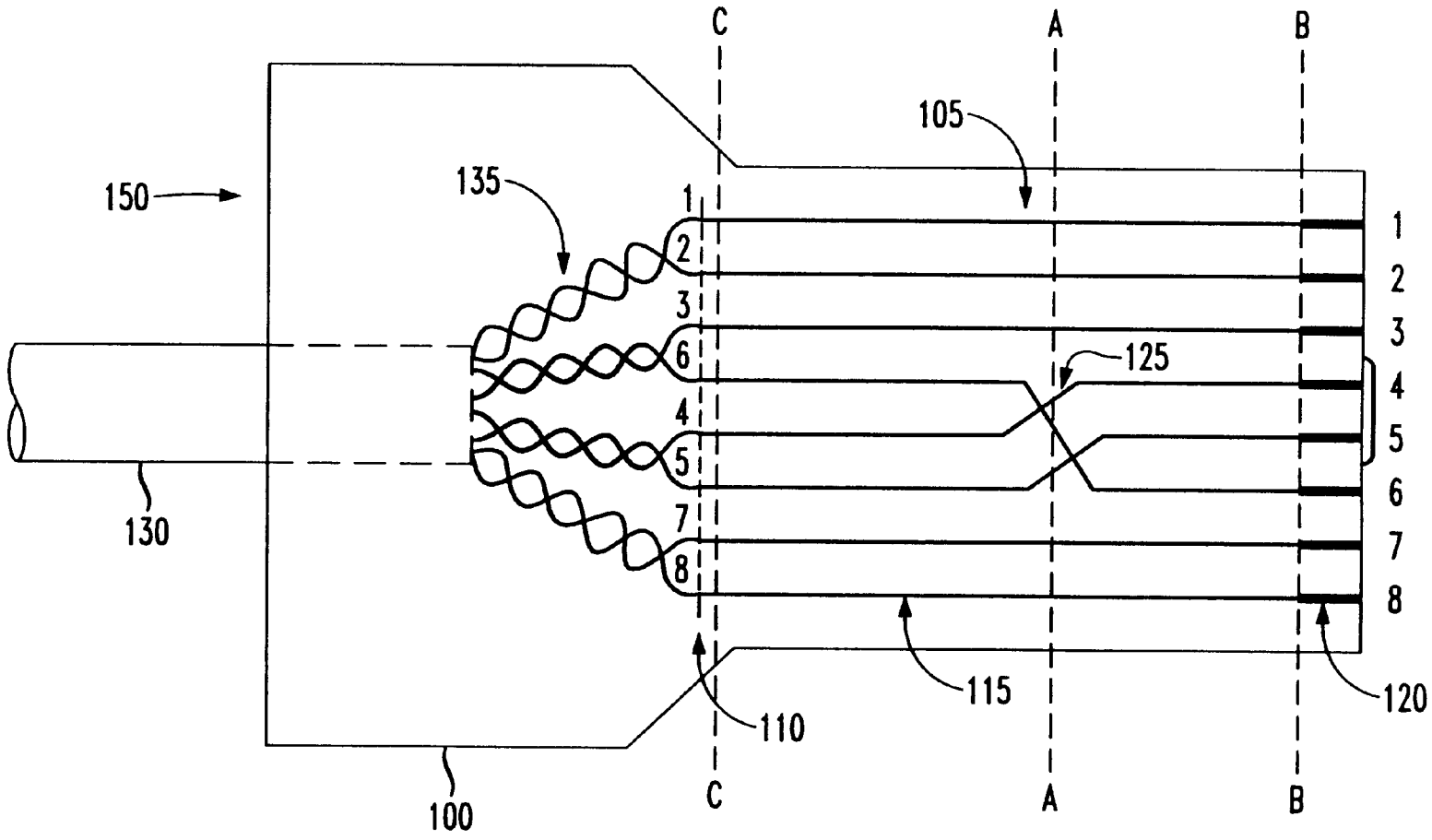
FIG. 1 is a simplified plan view of an illustrative embodiment of the crossover lead frame connector of the present invention showing two sample crossovers.
Figure 2:
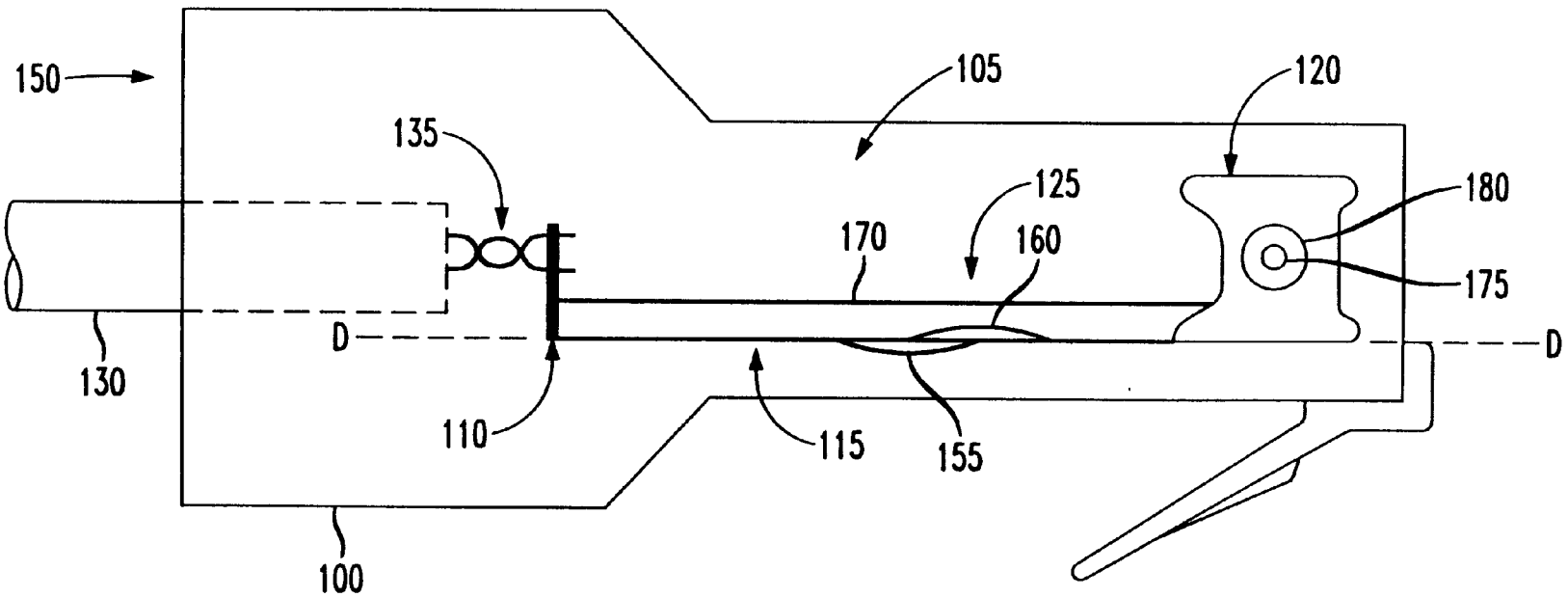
FIG. 2 is a simplified elevational view of an illustrative embodiment of the crossover lead frame connector of the present invention showing different illustrative methods of realizing crossovers.

In the illustrative preferred embodiment of the present invention shown in FIGS. 1 and 2, the crossover lead frame connector is illustrated as a crossover lead frame modular plug 150. Crossover lead frame modular plug 150 comprises a plug body 100 and a crossover lead frame structure 105 housed within plug body 100. Crossover lead frame structure 105 includes a plurality of termination points 110, a plurality of lead frame conductors 115, and a plurality of plug pins 120. Lead frame conductors 115 are arranged in crossover lead frame structure 105 so that they electrically connect termination points 110 and plug pins 120. Plug body 100 provides an opening and strain relief for a cable 130, wherein the conductors 135 of the cable are attached to the termination points 110 of crossover lead frame structure 105. In this way, crossover lead frame 105 electrically connects cable conductors 135 to plug pins 120.

Figure 5:
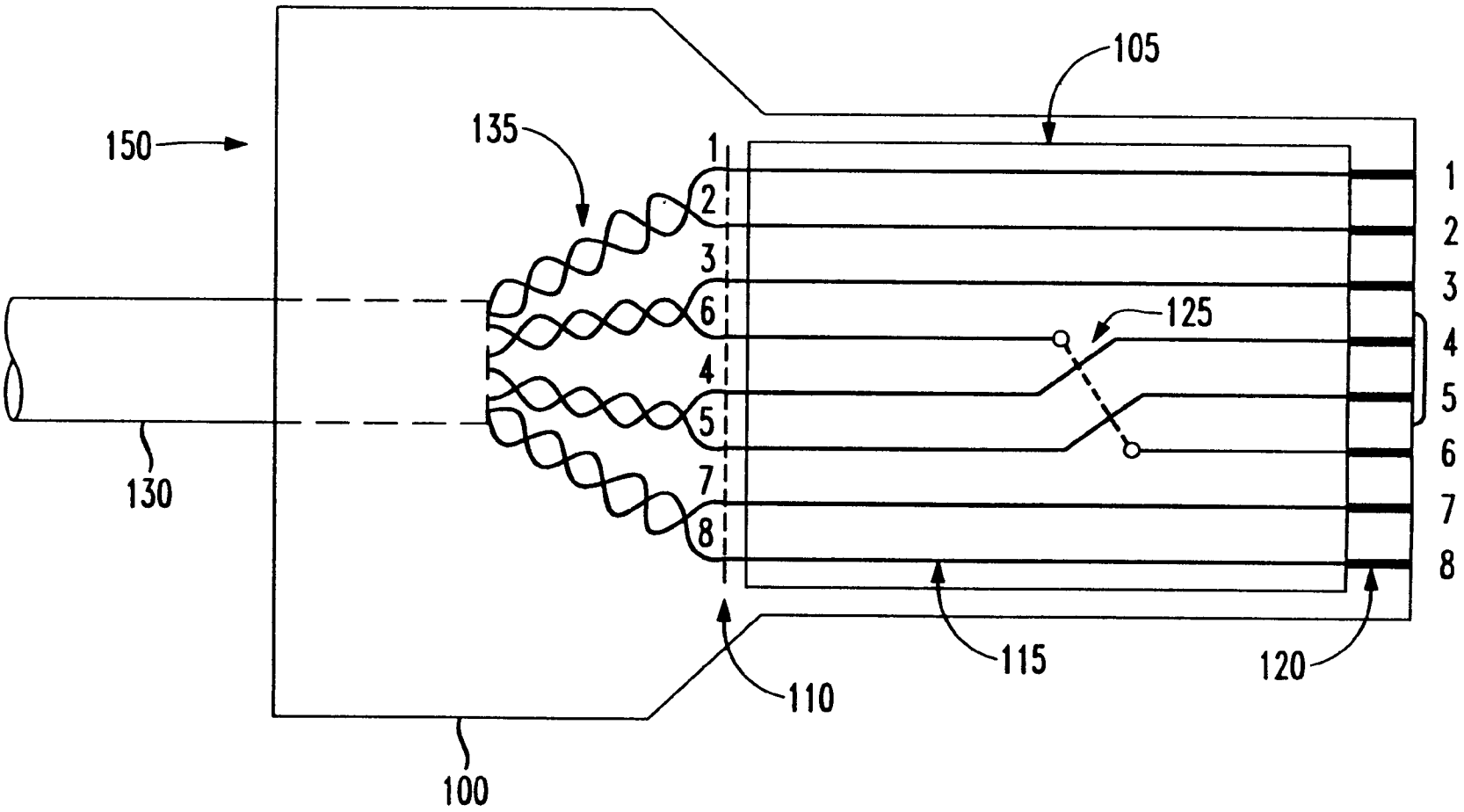
FIG. 5 is a simplified plan view of an illustrative embodiment of the crossover lead frame connector of the present invention showing two sample crossovers in a printed circuit board.

Termination points 110 may be manufactured separately from lead frame conductors 115 or they may be formed from a single piece of material. Similarly, plug pins 120 may be manufactured separately from lead frame conductors 115 or they may be formed from a single piece of material. In preferred embodiments of the invention, lead frame 105 includes one termination point 110 and one lead frame conductor 115 for each plug pin 120. Termination points 110 preferably comprise insulation displacement contacts, lead frame conductors 115 preferably comprise metal strips, and plug pins 120 preferably comprise metal blades. Other combinations of the numbers, arrangements, and types of termination points 110, lead frame conductors 115, and plug pins 120 may be used without departing from the spirit of the invention. For example, crossover lead frame structure 105 may comprise two termination points 110 connected by a lead frame conductor 115 in the shape of a "Y" to each plug pin 120. As another example, termination points 110 may be piercing terminals, solder terminals, or crimp fasteners, and lead frame conductors 115 may be insulated wires or metal traces in a printed circuit board (as shown in FIG. 5).

Lead frame conductors 115 are further arranged so that they comprise at least one crossover 125 wherein two or more lead frame conductors 115 cross one another, while remaining electrically isolated, in an axis that is substantially perpendicular to the plane in which lead frame conductors 115 predominantly reside. In the preferred embodiment of the invention, each crossover 125 is realized by providing a depression in at least one of the lead frame conductors 155, through which depression at least one other lead frame conductor 115 crosses. Other methods of providing crossovers 125 in lead frame conductors 115 may be used without departing from the spirit of the invention. For example, a crossover 125 could be realized by arching at least one conductor 160 over at least one other, by combining conductor arches 160 and depressions 155, or by positioning at least one of the lead frame conductors 170 at a different height with respect to the plane (line D—D in FIG. 2) in which the other lead frame conductors 115 predominantly reside.

These crossovers 125 give crossover lead frame structure 105 of the present invention the ability to rearrange the order of the signals between termination points 110 and plug pins 120. For example, crossovers 125 of FIG. 1 rearrange signals 6, 4, and 5 between termination points 110 and plug pins 120 so that they appear at the plug pins in the order 4, 5, and 6. Even though crossovers 125 shown in FIG. 1 cross three lead frame conductors 115 in the illustrated fashion, any number of lead frame conductors 115 may be used to connect any combination of termination points 110 and plug pins 120 without departing from the spirit of the invention.

Crossover lead frame structure 105 of the present invention also greatly simplifies the assembly of modular plug 150 as compared to the prior art. Through the crossover lead frame structure's ability to rearrange the order of the signals between termination points 110 and plug pins 120, a modular plug 150 can be manufactured wherein termination points 110 are arranged to match the most preferable order and arrangement of cable conductors 135, while still conforming to any required pin-signal assignments. For example, for optimal transmission performance when using twisted pair cable, it is preferable to keep the pairs (cable conductors 135 shown in FIG. 1) twisted for as long as possible up to the point of their connection to termination points 110 after unsheathing them from cable 130. By arranging termination points 110 so that both cable conductors 135 of each pair are terminated adjacent to one another, even though their signals 1–8 may not be adjacent at plug pins 120 due to the plug's pin-signal assignments, the assembler is relieved of the task of untwisting, fanning out, and routing conductors 135 to the appropriate locations.

Figure 3:
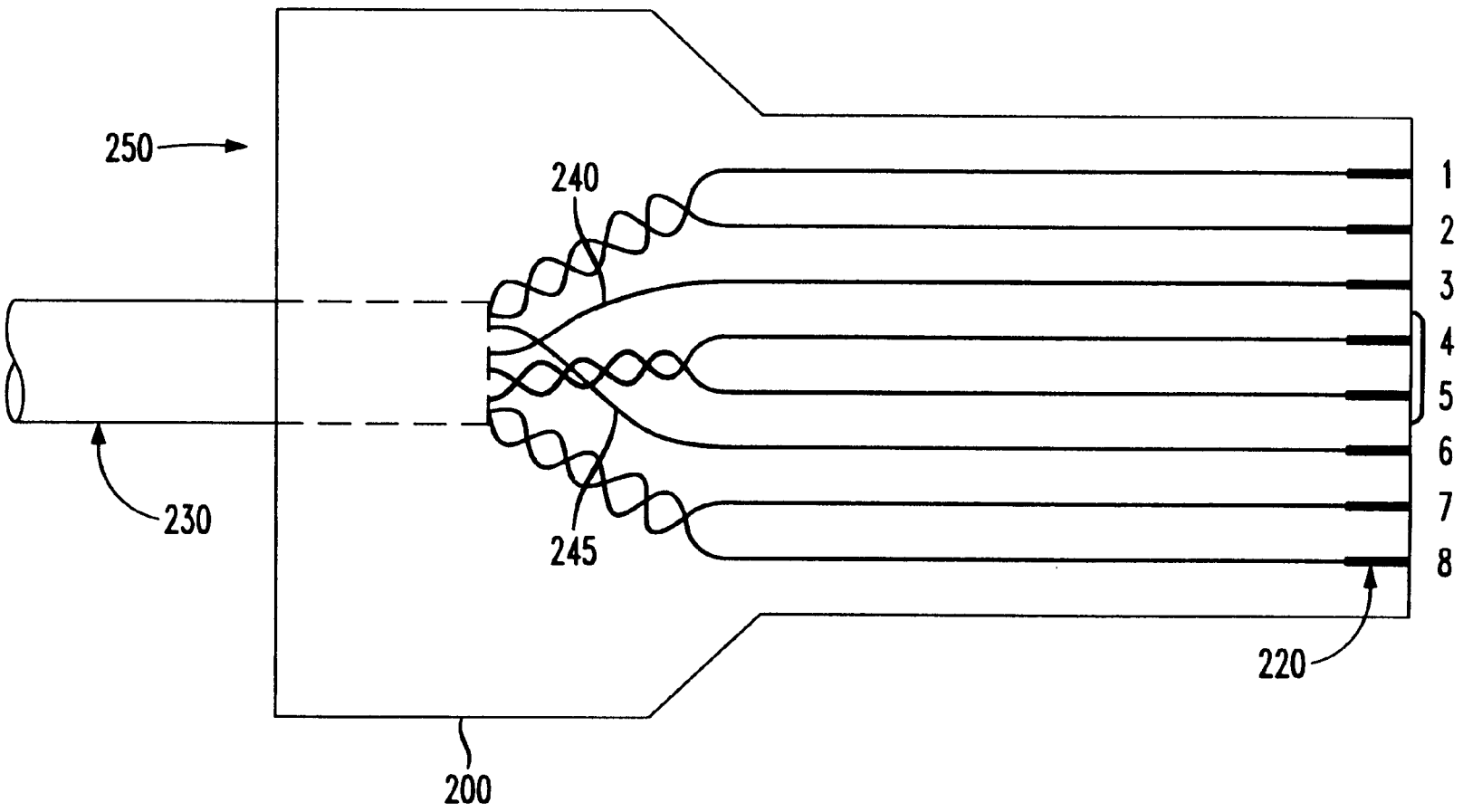
FIG. 3 PRIOR ART
FIG. 3 is a simplified plan view of a typical modular plug of the prior art showing the untwisting, fanning out, and routing required during plug-cable assembly.

As is shown in FIG. 3, the assembly of a modular plug 250 with a twisted pair cable 230 is much more difficult in the prior art. The cable conductors 240 and 245 of cable 230 must be carefully untwisted, fanned out, and routed inside the plug body 200 in order to make the illustrated connection at plug pins 220.

Figure 4:
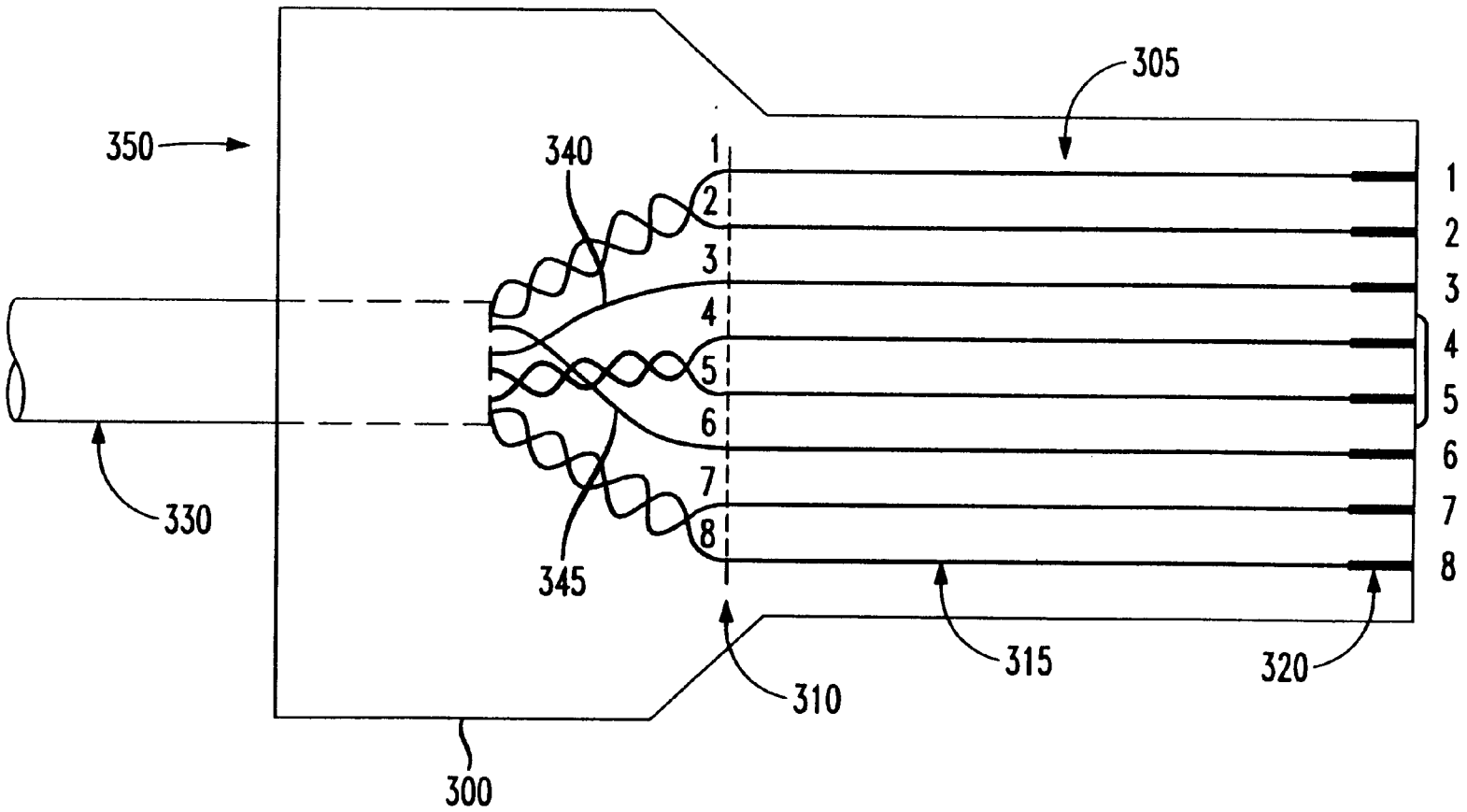
FIG. 4 PRIOR ART
FIG. 4 is a simplified plan view of a modular plug of the prior art, having a lead frame construction but no crossovers, showing the untwisting, fanning out, and routing required during plug-cable assembly.

As illustrated in FIG. 4, the lead frames 305 of the prior art are straight-feed-through lead frames that do not provide the crossovers 125 (FIG. 1) of the present invention. Lead frames 305 typically comprise one termination point 310 and one lead frame conductor 315 for each plug pin 320, wherein substantially parallel lead frame conductors 315 electrically connect one termination point 310 to each plug pin 320, and the relative positioning of the termination points 310 is substantially the same as that of the plug pins 320. Because of this arrangement of the lead frames 305 in the prior art, each variation of plug 350 with a different pin-signal assignment has to be wired differently, even though the same type of cable 330 is being used.

These difficulties in plug assembly in the prior art may result in a product of substandard quality in many instances. For example, plugs 250 (FIG. 3) may have cable conductors 240 and 245 that are untwisted more or less than the preferred amount, fanned out too little or too much, or routed inappropriately. Such imperfections may cause increases in the total level of crosstalk produced by plug 250 and the associated jack connection, resulting in a degradation of the overall transmission performance of the plug-jack connection.

Crossover lead frame modular plug 150 (FIG. 1) of the present invention virtually eliminates these types of imperfections. As described above, termination points 110 may be arranged to match a preferred cable conductor 135 layout. Such an arrangement can bring uniformity to the way in which cable conductors 135 are attached to termination points 110. For example, it allows the cable conductors 135 for a twisted pair cable 130 to be untwisted only minimally or not at all. Similarly, it removes the need to fan out or specially route cable conductors 135 in order to comply with the plug's pin-signal assignments. These simplifications of the assembler's task result in a more consistent attachment of cable conductors 135 to termination points 110 and a more consistent level of plug 150 crosstalk production.

Crossover lead frame structure 105 of the present invention also permits fine-tuning of the crosstalk production of plug 150. By shifting the position of crossovers 125 (line A—A in FIG. 1) toward plug pins 120 (line B—B), the crosstalk generated can be reduced. Similarly, by shifting the position of crossovers 125 in the direction of termination points 110 (line C—C), the crosstalk generated can be increased. This ability to manipulate the position of the crossovers 125 of lead frame conductors 115 enables a manufacturer to substantially fix the level of crosstalk that will be produced at the time plugs 150 are manufactured, with only minimal variation in that level resulting from plug-cable assembly.

The crosstalk produced in plug 150 may also be controlled by modification of plug pins 120. The plug pins 120 used in plug 150 may be any type of plug pin known in the art. For example, plug pins 120 may be plug pin blades or partial loops formed from lead frame conductors 115. By modifying the overall surface area of adjacent plug pins 120, the crosstalk between them can be increased or decreased. For example as shown in FIG. 2, with plug pin blades, wherein plug pins 120 comprise substantially flat pieces of metal with similar perpendicular measurements along the pin's flat surface, the crosstalk realized between two parallel plug pins 120 can be decreased by increasing the size of holes 175 and 180 within the pin blades.

Figure 6:
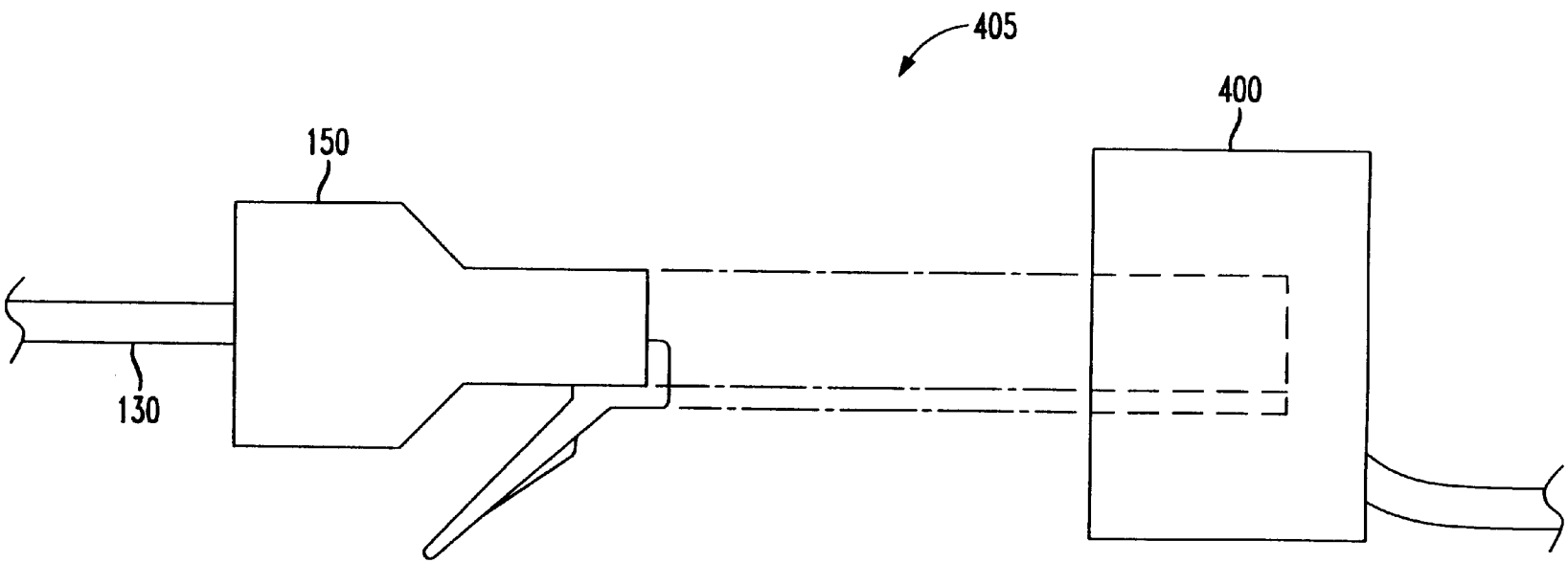
FIG. 6 is a simplified elevational view of an illustrative embodiment of an electrical connector assembly of the present invention incorporating a crossover lead frame plug and a crosstalk-canceling jack.

As shown in FIG. 6, a crossover lead frame modular plug 150 can be mated to a crosstalk-canceling jack 400 to form an electrical connector assembly 405.

It will be understood that the foregoing is only illustrative of the principles of the invention and that various modifications can be made by those skilled in the art without departing from the scope and spirit of the invention. For example, the invention can be used with many different types of pins 120, termination points 110, lead frame conductors 115, cables 130, and connector bodies 100. Furthermore, the invention can also be used with any number of pins 120, termination points 110, lead frame conductors 115, cable conductors 135, and lead frame conductor crossovers 125.

The invention claimed is:

1. An electrical connector assembly comprising:

a crosstalk-canceling mating connector that produces a quantity of canceling crosstalk; and an electrical connector comprising:

a connector body; and a crossover lead frame structure, wherein the crossover lead frame structure comprises a plurality of pins and a plurality of signal paths, the plurality of pins is configured in the connector body to match a preferred arrangement of pins in the crosstalk-canceling mating connector forming a preferred pin configuration, the plurality of signal paths electrically connects a preferred arrangement of a plurality of cable conductors to the plurality of pins in the preferred pin configuration, the plurality of signal paths forms at least one crossover wherein at least two of the plurality of signal paths physically cross over one another while remaining electrically isolated, and the at least one crossover is tuned to control a level of produced crosstalk which is produced in the electrical connector and which substantially matches and substantially cancels the quantity of canceling crosstalk produced by the crosstalk-canceling mating connector.

2. The electrical connector assembly of claim 1, wherein each of the plurality of signal paths comprises an insulated wire.

3. The electrical connector assembly of claim 1, wherein each of the plurality of signal paths comprises a metal strip.

4. The electrical connector assembly of claim 1, wherein each of the plurality of signal paths comprises a metal trace in a printed circuit board.

5. The electrical connector assembly of claim 1, wherein the connector body comprises a modular plug body.

6. The electrical connector assembly of claim 1, wherein the plurality of pins comprises pin blades.

7. The electrical connector assembly of claim 1, wherein the plurality of signal paths comprises:

a plurality of termination points electrically and physically connected to the plurality of cable conductors in the preferred arrangement; and a plurality of lead frame conductors, wherein the plurality of lead frame conductors electrically connects the plurality of termination points to the plurality of pins in the preferred pin configuration, and the plurality of lead frame conductors forms at least one crossover wherein at least two of the plurality of lead frame conductors physically cross over one another while remaining electrically isolated.

8. The electrical connector assembly of claim 7, wherein a single piece of material is used to form a combination of one of the plurality of pins, one of the plurality of lead frame conductors and one of the plurality of termination points.

9. The electrical connector assembly of claim 7, wherein separate pieces of material are used to form at least one of the plurality of lead frame conductors, the plurality of termination points, and the plurality of pins.

10. The electrical connector assembly of claim 7 wherein the crossover lead frame structure comprises one of the plurality of termination points and one of the plurality of lead frame conductors for each of the plurality of pins.

11. The electrical connector assembly of claim 7, wherein the plurality of termination points comprises insulation displacement contacts.

12. The electrical connector assembly of claim 7, wherein the plurality of termination points comprises piercing terminals.

13. The electrical connector assembly of claim 7, wherein the plurality of termination points comprises solder terminals.

14. The electrical connector assembly of claim 7, wherein the plurality of termination points comprises crimp fasteners.

15. The electrical connector assembly of claim 7, wherein the plurality of pins comprises extensions of the plurality of lead frame conductors.

16. The electrical connector assembly of claim 7, wherein the crossover is realized by a depression in at least one of the plurality of lead frame conductors, through which depression at least one other of the plurality of lead frame conductors passes.

17. The electrical connector assembly of claim 7, wherein the crossover is realized by an arch in at least one of the plurality of lead frame conductors, under which arch at least one other of the plurality of lead frame conductors passes.

18. The electrical connector assembly of claim 7, wherein the crossover is realized by both a depression in at least one of the plurality of lead frame conductors, through which depression at least one other of the plurality of lead frame conductors passes, and an arch in at least one of the plurality of lead frame conductors, under which arch at least one other of the plurality of lead frame conductors passes.

19. The electrical connector assembly of claim 7, wherein the crossover is realized by the plurality of lead frame conductors being positioned at different heights with respect to a plane in which the plurality of lead frame conductors predominantly reside.

20. The electrical connector assembly of claim 1, wherein all of the plurality of signal paths exist in a single physical structure.

21. The electrical connector assembly of claim 20, wherein the single physical structure is a printed circuit board.

22. A method of providing a tuned electrical connector assembly comprising:

providing a crosstalk-canceling mating connector that produces a quantity of canceling crosstalk; and providing an electrical connector by:

configuring a plurality of pins in a connector body so that the plurality of pins match a preferred arrangement of pins of the mating connector to form a preferred pin configuration;

arranging a plurality of termination points in the connector body to match a preferred arrangement of a plurality of cable conductors to form a preferred termination point arrangement;

connecting the plurality of pins in the preferred pin configuration to the plurality of termination points in the preferred termination point arrangement with a plurality of lead frame conductors, wherein the plurality of lead frame conductors comprise at least one crossover wherein at least two of the plurality of lead frame conductors physically cross one another while remaining electrically isolated; and tuning the at least one crossover to control a level of produced crosstalk which is produced in the electrical connector and which substantially matches and substantially cancels the quantity of canceling crosstalk produced by the crosstalk-canceling mating connector.

23. The method of claim 22, wherein the method further comprises:

controlling the position of at least one of the at least one crossover in the plurality of lead frame conductors with respect to the positions of the plurality of termination points and the plurality of pins.

24. The method of claim 22, wherein the method further comprises:

controlling the surface area of at least one of the plurality of pins.

* * * * *